US006714654B2

(12) United States Patent
Lichtblau

(10) Patent No.: US 6,714,654 B2
(45) Date of Patent: Mar. 30, 2004

(54) HEARING AID OPERATIVE TO CANCEL SOUNDS PROPAGATING THROUGH THE HEARING AID CASE

(76) Inventor: George Jay Lichtblau, 23 Pin Pack Rd., Ridgefield, CT (US) 06877

( * ) Notice: Subject to any disclaimer, the term of this patent is extended or adjusted under 35 U.S.C. 154(b) by 122 days.

(21) Appl. No.: 10/068,487

(22) Filed: Feb. 6, 2002

(65) Prior Publication Data

US 2003/0147544 A1 Aug. 7, 2003

(51) Int. Cl.[7] ..... H04R 25/00

(52) U.S. Cl. ..... 381/317; 381/322

(58) Field of Search ..... 381/71.1, 71.2, 381/72, 151, 312, 313, 317, 318, 328, 331, FOR 127, FOR 128, FOR 130, FOR 140, 380

(56) References Cited

U.S. PATENT DOCUMENTS

| | | | | |
|---|---|---|---|---|
| 4,622,440 A | | 11/1986 | Slavin | 381/68.1 |
| 5,201,006 A | * | 4/1993 | Weinrich | 381/68 |
| 5,390,254 A | * | 2/1995 | Adelman | 381/68 |
| 5,402,496 A | | 3/1995 | Soli et al. | 381/94 |
| 5,526,819 A | | 6/1996 | Lonsbury-Martin et al. | 128/746 |
| 5,692,059 A | | 11/1997 | Kruger | 381/151 |
| 5,757,933 A | | 5/1998 | Preves et al. | 381/68.1 |
| 5,933,506 A | * | 8/1999 | Aoki et al. | 381/151 |
| 6,068,589 A | | 5/2000 | Neukermans | 600/25 |
| 6,421,448 B1 | * | 7/2002 | Arndt et al. | 381/312 |
| 2002/0141602 A1 | * | 10/2002 | Nemirovski | 381/93 |
| 2002/0143242 A1 | * | 10/2002 | Nemirovski | 600/300 |
| 2003/0007647 A1 | * | 1/2003 | Neilsen et al. | 381/60 |

FOREIGN PATENT DOCUMENTS

| | | |
|---|---|---|
| EP | 0 354 698 B1 | 2/1990 |
| EP | 0 364 037 B1 | 4/1990 |
| EP | 0 782 371 B1 | 3/2001 |
| WO | WO 93/23942 | 11/1993 |
| WO | WO 94/25957 | 11/1994 |
| WO | WO 96/29009 | 9/1996 |
| WO | WO 97/44987 | 11/1997 |
| WO | WO 98/19498 | 6/1998 |
| WO | WO 98/43567 | 10/1998 |

* cited by examiner

*Primary Examiner*—Curtis Kuntz
*Assistant Examiner*—Brian Ensey
(74) *Attorney, Agent, or Firm*—Weingarten, Schurgin, Gagnebin & Lebovici LLP

(57) ABSTRACT

Apparatus for use in a hearing aid wherein a first microphone is connected to the hearing aid case and exposed to free air and a second microphone is connected to the hearing aid case and sealed from free air. The audio inputs from the two microphones are applied to a subtractive circuit so as to cancel any audio signals transmitted through the case of the hearing aid while passing audio signals received by the microphone exposed to free air.

57 Claims, 4 Drawing Sheets

HEARING AID OPERATIVE TO CANCEL SOUNDS PROPAGATING THROUGH THE HEARING AID CASE

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

The purpose of this invention is to discriminate between audio signals propagated through the air and noise signals which are propagated through the plastic shell of the hearing aid. Most of the noise transmitted through the plastic case of the hearing aid is created within the body itself; i.e. chewing, talking, walking, etc.

The present invention utilizes two microphones, both coupled to the hearing aid case, wherein one microphone is exposed to sounds propagating through the air and the second microphone is purposely sealed from sounds propagating through the air.

In a typical hearing aid, one or more microphones convert sound transmitted through the air to an electrical signal. A signal processing system (amplifiers, filters, digital filtering, etc.) processes the signal, and a loudspeaker converts the processed electrical signal back to an audio signal. The hearing aid apparatus is enclosed in a plastic case that is placed In The Ear (ITE) canal or Behind The Ear (BTH).

The microphone(s) is(are) attached to the plastic case and the case is acoustically coupled to the bone and flesh of the wearer. Therefore, any sounds that originate in the skull are conducted to the microphone(s) and amplified and echoed back to the ear.

There have been many inventions for hearing aids wherein two or more microphones are used to cancel ambient noise. Both microphones "hear" the same audio signal that is propagating through the air. The noise cancellation technique assumes that the noise source is much further distant from the two microphones as compared to the local or desired audio signal. As long as the noise is generated at a distance which is large compared to the distance between the two microphones, the signals received at each microphone will be almost equal in amplitude and phase. Then a "difference device", for example, a differential amplifier, can subtract the two microphone signals and effectively cancel the ambient noise. In addition, two or more microphones have been used with a differential amplifier to develop a directional microphone for use on a hearing aid. However, in all cases, all of the microphones were exposed to the audio signals propagating through the air in order to produce the desired effect.

In U.S. Pat. No. 5,526,819, two microphones are used to attempt to cancel out high amplitude "body noises" (such as a cough) from the very low level desired (DPE) audio information. However, in this patent, both microphones are exposed to the same audio signals in the air. One of the microphones is designed to not respond to the DPE signals that are of a fixed and known frequency in this test. It is also "necessary" that the microphones be different. In addition, the patent does not give any information as to how the "second" microphone, which is less "sensitive" than the first microphone, cancels out high level noise signals but does not cancel out the low level DPE signal. There is some "hint" of how the second "less sensitive" microphone works, since the patent states, "The output of 30B is of less sensitivity so that the frequency components of the DPE signal are missing from the signal applied to the minus input of the differential amplifier." In other words, the less sensitive microphone is designed to be "less sensitive" at the specific frequency that is being looked for in this patent; i.e. frequencies F1 and F2 are applied to the ear and the instrument looks for an "echo" at 2F1–F2. Also, the ratio of F2 to F1 is fixed. This patent clearly states that the typical test procedure varies F1 from 1,000 Hertz to 8,000 Hertz in steps of 100 Hertz. Therefore, the electronics must vary the frequency response of the second microphone for each step in the input frequencies.

In claim 1, lines 21 to 29, the patent states: "Said eartip including a second microphone means with a second output lead connected thereto for generating a second electrical signal on said second output lead which is proportional to said other body noises but is not substantially proportional to distortion product emission tone generated in the ear of said human being at the frequency of 2F1–F2." This claim clearly states that the second microphone must be very frequency selective since it is specifically not substantially sensitive to a specific frequency. Again, since the patent requires that the frequencies F1 and F2 be varied over a wide range (typically 1 kHz to 8 kHz in 100 Hertz steps), this means that the frequency selectivity of the second microphone must also be varied accordingly.

In U.S. Pat. No. 6,068,589, two or more microphones are used, all exposed to free air, but placed in different positions on the body (skull) so that noise generated from a relatively large distance is coupled almost equally to both microphones and canceled out, wherein noise generated nearby is selectively coupled much greater to the closer of the two microphones and less selectively to further microphone. Therefore, the "nearby" audio signal is amplified much more than those audio signals generated at a much greater distance. This improves the signal to noise ratio since the local signal is considered the "desirable signal" as compared to the noise generated at a distance. In addition, by locating the microphones on opposite sides of the skull, it is possible to increase the "directivity" of the hearing aide. Again, all of these microphones must be exposed to all of the audio signals transmitted through the air and there is no mention of using multiple microphones to cancel noise directly coupled to the hearing aid case and generated within the body.

U.S. Pat. No. 4,622,440 also indicates the use of two microphones that are physically separated and exposed to the air in order to "hear" the audio signals transmitted through the air. As in the previous patents, this patent subtracts the audio signals generated in each microphone in order to cancel noise generated at a "distance" that is large compared to the physical space between the two microphones. If this "distance" is relatively large compared to the physical separation of the two microphones, than the signals received by the two microphones will be substantially equal in amplitude and phase and may be canceled using a differential amplifier.

Audio signals generated much closer to the two microphones will be coupled greater to one microphone than the other and will not be completely canceled. In this type of circuit, both microphones are exposed to air in order to cancel noise generated at a distance. This type of circuit can also be used to enhance the "directivity" of a microphone.

U.S. Pat. No. 5,757,933 is almost identical to U.S. Pat. No. 4,622,440 except that this patent includes the use of a switch to either add the signals of the two microphones together or to subtract the signals from the two microphones. By varying the phase and gain of one microphone versus the other, the microphones can be made somewhat "directional". Both microphones must be exposed to the air.

U.S. Pat. No. 5,402,496 again discusses the use of two microphones, both exposed to hear the audio signals transmitted through the air. The output of one microphone passes through a "first filter". To quote: "The first filter generates a reference signal by selectively passing an audio spectrum of the input signal which primarily contains the undesired component." This statement alone says that one must first "know" what the "undesired component" (i.e. noise) is, which is not useful in situations in which it is not possible to "know" in advance what the noise is. In addition, in this patent, both microphones are not identical.

Also, according to this invention, only one microphone is actually required. The output from this microphone is passed through a "first" filter as well as directly to the remainder of the signal processing electronics. There appears to be no explicit mention of a "second" microphone in the claims.

EP 0 782 371 B1 refers to the design of a microphone for use in hearing aids, particularly for use in "in-the-ear" (ITE) hearing aids. This patent clearly defines a technique for "mechanically" mounting a microphone in a hearing aid so that the sudden motion of the body does not pass from the body to the hearing aid shell and then to the hearing aid microphone. If this sudden motion is coupled to the microphone, the audio signal is amplified by the hearing aid electronics and passed into the ear.

The patent describes in great detail the mechanical mounting of such a microphone. This patent does not discuss nor hint of the application of a second microphone and electronics to cancel mechanical vibrations received by both microphones.

WO 97/44987 describes a hearing aid system wherein one microphone is connected to an amplifier, battery and loudspeaker (microactuator) and placed in a hermetically sealed case. The patent document also suggests the use of an acoustic array of individual microphones arranged in a horizontal row across the electronics module. This array of microphones is connected to electronics that creates a "directional" microphone which may enhance the sounds of interest while concurrently reducing noise.

In this patent there is no attempt to reduce noise which is directly coupled to the electronic "module" from being amplified and fed back to the ear. There is no mention of using one microphone that is sealed from audio signals propagated through the air and another microphone that is purposely exposed to audio signals propagated through the air.

EP 0 364 037 B1 teaches the use of two microphones, both exposed to audio signals propagated through the air, wherein one microphone is specifically designed to be sensitive to audio signals that originate close to it and the second microphone to be sensitive to audio signals which originate at a relatively large distance from the microphone. The outputs of the two microphones are electronically subtracted from each other in order to suppress hearing aid oscillation caused by audio feedback from the loudspeaker to the microphone.

In this patent the two microphones "must" be of different design in order for one microphone to be only sensitive to sound "close to it". The patent does not discuss the problem of audio signals coupled directly to the microphones via the hearing aid case. In addition, both the microphones in this patent must be exposed to the air.

WO 94/25959 describes a microphone and electronic module wherein the microphone is placed in the ear and sensitive only to sounds passing from the inside of the ear to the outside of the ear (the opposite direction from the normal hearing aid). These "outbound" audio signals are amplified and electrically transmitted to a remote receiver. Noise reduction and cancellation features are described in this invention. This patent document requires that the inner ear be sealed from the air external to the ear and that one microphone be placed into this sealed chamber in order to be subjected to audio signals originating from the inner ear. A second microphone is placed external to the ear to be sensitive to noise originating outside of the ear. The signals from these two microphones are electronically processed to subtract the noise external to the ear from the same type of noise generated from inside the ear.

This patent clearly describes the use of a "structural configuration of the earpiece and gasket around extension section 147 (that) substantially eliminates audio vibrations conducted by the bone and tissue of the earpiece wearer." "Such sound gasketing avoids audio vibration pickup of sound transmitted by the canal wall. Furthermore, the gasket composition dampens any audio vibration pickup of sound through the gasket material touching the canal inner wall."

EP 0 354 698 B1 specifically concerns hearing aids and their assembly and is especially concerned with the long-felt need to avoid the amplification of noise caused by vibrations of either the casing or the components of the hearing aid. This patent attempts to solve this problem by making the hearing aid case out of a new plastic type material described as "a viscoelastic layer adhering the transducer to the casing". This solution is totally mechanical and the patent specifically states that ". . . some hearing aids include electronic devices to filter out noise. Not only are electronic devices quite expensive, but they also can take up valuable space." Thus, this patent attempts to solve the problem of vibrations coupled to the hearing aid case by mechanical means.

WO 96/29009 describes a configuration of two microphones and electronics wherein one microphone is positioned to sense body sounds of a patient when the transducer (microphone) is placed against the patient's skin and the second microphone is positioned to sense noise in the external environment close to the first microphone. In this document, the two microphones are purposely "acoustically and mechanically isolated from each other". This is the classical case wherein two microphones are used to subtract one source of noise from another. However, in this case the external noise is normally very much larger than the "internal noise" generated by the body. Therefore, there must be very specific electronic signal processing to subtract the very large external noise from the very small internal noise and not end up with a very large (negative phase) external noise.

Since the level of the external noise is not known relative to the internal noise, this document requires the use of a "digital signal processor" coupled to the first and second microphones to process the audio signals to produce an output signal that is indicative of the very small body sounds as compared to the very large external noise. How the "digital signal processor" actually determines how to subtract the very large external noise from the very small internal noise is not described.

WO 98/43567 describes a hearing aid noise cancellation system wherein the hearing aid specifically does not completely "plug the ear"; that is, the hearing aid has a "vent" so that sound can propagate directly to the inner ear without passing through the electronics of the hearing aid. In this type of hearing aid, the ear hears the sum of sounds received directly through the "vent" and also via the electronic microphone and loudspeaker of the hearing aid. In this document there is only one microphone. This microphone and the loudspeaker are both acoustically coupled to the inner ear via a hollow tube. Any sound that reaches the inner ear via the vent is (1) directly heard by the inner ear and (2) picked up by the microphone, processed, and fed back to the loudspeaker to cancel unwanted "noise" signals. The process of active noise cancellation is well known (see U.S. Pat. No. 4,473,906). As discussed in the WO 96/29009 patent document above, the WO 98/43567 patent document must "predetermine" what the noise is in order to cancel out this noise. This is the basic problem of all hearing aids designed to improve the intelligibility of speech signals. This patent does show any specific method of signal processing to improve the intelligibility of speech signals.

WO 98/19498 relates to the design of an ear muffler to reduce ambient noise from entering the ear and protect the ear against damage. This patent does not use any microphones or electronics.

WO 93/23942 describes the development of an "ear-mounted microphone" and speaker that does not require entry of any physical structure within the ear canal. In this patent document, "Acoustical isolation means is coupled between the speaker element and the housing for selectively isolating undesirable frequencies that might interfere with sensitivity of audio pick up at the microphone . . . " This patent document does not use two microphones to acoustically isolate the speaker from the housing using electrical means. It clearly uses mechanical means to isolate the speaker from the housing. Also, in this document, the speaker directs its sound "outside" of the ear and not into the ear. In the exact reverse from hearing aids, this invention places the microphone inside the ear and the speaker on the outside of the ear. The document also claims to have noise reduction from the case to the microphone because the sound coupled from the housing to the vibration rings and then to the microphone somehow have equal and opposite phase relationships when they arrive at the microphone. There is, however, no explanation of this conclusion. The document also states: ". . . it is necessary to acoustically isolate the speaker element 13 from the casing. In the present invention, this is accomplished by tuning the insulation means 50 similar to operation of a band pass filter within radio circuitry. Specifically, the speaker element 13 is mounted to the end housing 36 through a nonvibrational ring 50 which extends around the speaker element and operates to isolate the housing as sound insulation means from the speaker element." The "nonvibrational ring," however, is not described or explained.

SUMMARY OF THE INVENTION

The present invention relates to a hearing aid that addresses the problem of sounds created internally. In the present hearing aid, at least two microphones are used, one attached to the plastic case of the hearing aid and isolated from free air, and a second microphone, also attached to the plastic case, but exposed to free air. Only the second microphone, open to the air, converts audio information conducted through free air from an external audio source to electrical signals. Both microphones convert audio signals that are conducted via the plastic case to electrical signals. The two microphones are connected to a difference device such as a differential amplifier that causes cancellation of the signals that are conducted through the plastic case. Because the path length of the audio signals via the plastic case is very short, the amplitude and phase of the audio signals received by both microphones is nearly equal. Therefore, high cancellation of any audio signals present in the plastic case can be achieved. The gain and phase of one microphone versus the second microphone could be adjusted to enhance cancellation.

DESCRIPTION OF THE DRAWINGS

The invention will be more fully understood from the following detailed description taken in conjunction with the accompanying drawings in which.

DETAILED DESCRIPTION OF THE INVENTION

To aid in understanding the present invention, the case of two external microphones is distinguished from the present invention in which an internal and an external microphone are used. When two external microphones are used in a "subtractive" mode through the use of, for example, a differential amplifier, the "net" audio output from these microphones is radically reduced compared to that of a single microphone. This reduction is due to the necessarily close spacing of the two microphones in a miniature device such as a hearing aid. For example, the spacing between two microphones may be 0.5 inches.

Figure 1:
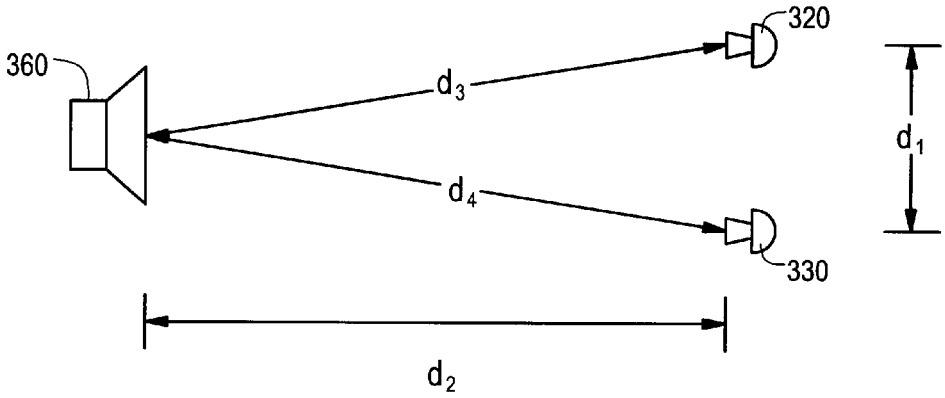
FIG. 1 is a schematic view of an audio signal generated at a physical location centered between two microphones.

When an audio signal is generated at a distance of 3 feet from the ear, the amplitude of the signal received at the two microphones so closely spaced is virtually identical. Under ideal conditions, if the audio signal is generated at a physical location centered between the two microphones, there is a total cancellation of the audio signal via a differential amplifier. Referring to FIG. 1, two microphones 320, 330 are placed a distance $d_1$ apart and an audio source 360 is located at a distance $d_2$ from each of two microphones and equidistant between each microphone. In this instance, the distances $d_3$ and $d_4$ are equal. Thus, the amplitude and phase of the audio signal are identical at each microphone. When the microphone signals are subtracted from each other via a differential amplifier, the net audio signal is zero.

Figure 2:
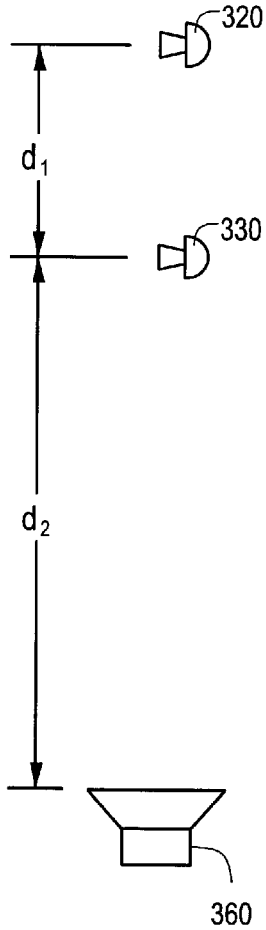
FIG. 2 is a schematic view of an audio signal generated at a physical location farthest from one microphone relative to the other microphone.

The conversion gain from the audio level to the electrical level for a one-microphone system can be defined as equal to 1. Thus, for a two-microphone system used in the differential mode, the conversion gain from the audio level to the electrical level is not fixed, but is determined by the angle of the audio signal relative to the two microphones, the distance of the audio signal from the two microphones, and the distance between the two microphones. FIG. 2 illustrates the location of greatest audio to electrical conversion for the two-microphone system, wherein the signals from the two microphones are subtracted from each other using a differential amplifier. The typical conversion gain from audio to electrical for a two-microphone system is significantly less than for a simple one-microphone system. The typical gain of a one-microphone system compared to a two-microphone system can be calculated as follows:

A simplified audio level can be given by:

$$V_x = K/d,$$

where $V_x$=voltage out of microphone X;

K=microphone sensitivity constant whereby the voltage output of a microphone is proportional to the audio level input; and d=distance between microphone to audio source. This equation is relatively accurate when the distance $d_2$ is much greater than $d_1$. Thus, for the case in which the two microphones are 0.5 inch apart and the audio source is 36 inches from microphone 330:

$$V_1 = K/36 \text{ and}$$

$$V_2 = K/36.5.$$

Thus $$V_1 - V_2 = (K/36) - (K/36.5)$$

$$= 0.5K/(36 \times 36.5),$$

and $$V_1/(V_1 - V_2) = (K/36)/(0.5K/(36 \times 36.5))$$

$$= 36.5/0.5$$

$$= 73.$$

Accordingly, the conversion gain from a one-microphone system is approximately 73 times greater than the conversion gain from a two-microphone differential system. This conclusion means that the audio amplifier gain for a two-microphone system must be at least 73 times greater than that required for the one-microphone system to obtain the same audio level input to the ear.

Figure 3:
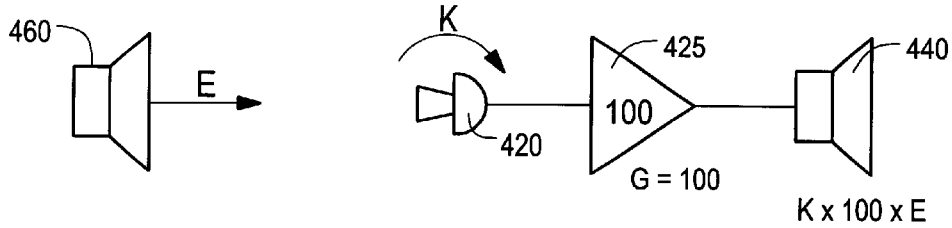
FIG. 3 is a schematic diagram for determining a desired audio output level for a one-microphone hearing aid.

The desired audio output level for a hearing aid can be determined from a one-microphone system, illustrated in FIG. 3. The single microphone 420 has a conversion gain of K (audio input to electrical output) followed by an audio amplifier 425 with a gain of 100. The signal from the amplifier drives a loudspeaker 440 located within the hearing aid. The relative audio output level is 100K×E, where E represents an external audio signal from a source 460. This output level sets the audio level required for normal hearing.

Figure 4:
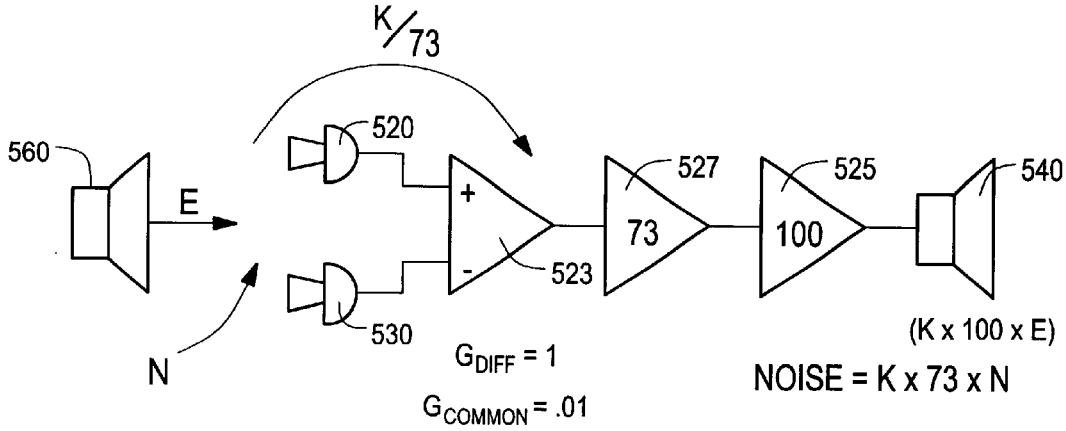
FIG. 4 is a schematic diagram of the audio output level for a two-microphone hearing aid in which both microphones receive external audio signals through free air.

FIG. 4 illustrates a system with two microphones 520, 530 using a differential amplifier 523 with a gain of one and a common mode rejection ratio of 100. Thus, the differential amplifier passes one percent (0.01) of the audio signal if both audio inputs are equal and has a gain of one (1) for audio signals from only one microphone. (A differential amplifier with a rejection ratio of 100 (40 dB rejection) is about the best that can be done using matching resistors with a tolerance of 1%.) In FIG. 4, E represents an external audio signal from a source 560 and N represents a noise signal generated within the wearer's body and coupled to both microphones attached to the case of the hearing aid.

Using identical microphones 520, 530 and assuming that the audio source is located 36 inches from the microphones, the conversion gain of the two-microphone system is at least 73 times less than the one-microphone system. Thus, to arrive at a final audio level of 100K×E, a further amplifier 527 with a gain of 73 is added in series with the first amplifier 523 and the amplifier 525 with a gain of 100.

Figure 5:
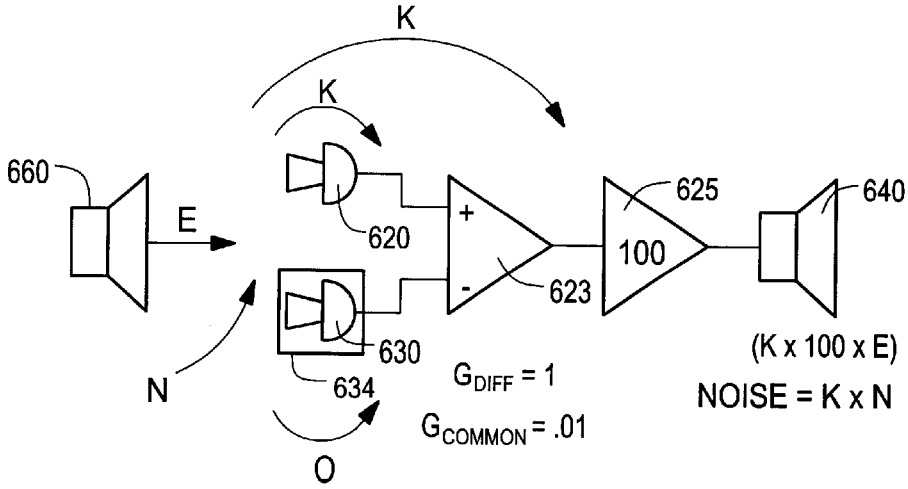
FIG. 5 is a schematic diagram of the audio output level for a two-microphone hearing aid of the present invention in which one microphone is sealed from external audio signals through free air.

Referring to FIG. 5, in the present invention, a first microphone 620 is used in accordance with the above discussion. A second microphone 630 is attached to the case of the hearing aid and sealed from the air, illustrated schematically in FIG. 5 by placing the microphone in a box 634. Because the audio signal E from a source 660 is heard only by the first microphone 620, this microphone has a conversion gain of K. Because the second microphone 630 is sealed from the air, it has a conversion gain of 0 for sounds that are transmitted through the air, but a conversion gain of K for sounds transmitted through the case of the hearing aid. Thus, for sounds transmitted through the air, the conversion gain of the first microphone through the differential amplifier 623 is also K. Therefore, the audio amplifier 625 has a gain of 100 to be equal to the one-microphone case.

When noise is generated within the wearer's body, it is coupled directly to the case of the hearing aid. If the second microphone 630 were not sealed, as illustrated in FIG. 4, the noise source N would be coupled to both microphones equally and would be passed through the differential amplifier with a common mode rejection of 100 (gain of 0.01). Therefore, the noise output of the differential amplifier would be 0.01N. This is multiplied by 73 and by 100 to result in a noise output of 73N.

When the second microphone is sealed, as in the present invention, the noise N is also coupled to both microphones equally and passed through the differential amplifier. Therefore, the output of the differential amplifier is again equal to 0.01N. This output is amplified by a gain of 100 for a net output noise of 1N. Therefore, for noise coupled directly to the shell of the hearing aid, that is, noise generated within the body, the noise generated in the ear is 73 times less when the second microphone is sealed from the air.

Figure 6:
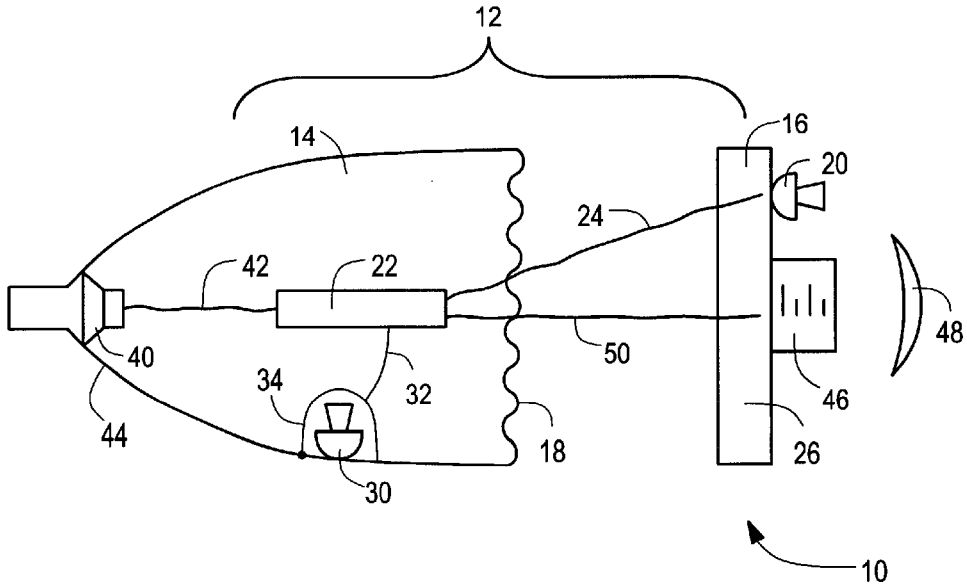
FIG. 6 is an exploded view of a hearing aid according to the present invention.

A hearing aid 10 according to the present invention is illustrated schematically in FIG. 6. The hearing aid shown is an in-the-ear (ITE) type hearing aid and includes a case 12 having a shell 14 and a faceplate 16 attached to a distal end 18 of the shell 14. The shell and faceplate may be formed, for example, of molded plastic. The faceplate is attached to the shell in any suitable manner, as known in the art.

A first external microphone 20 is in electrical communication with an electronics package 22 by, for example, a twisted pair of wires 24. The external microphone is attached to an outer or distally facing side 26 of the faceplate 16 of the case. The external microphone 20 is able to pick up sounds propagating through free air, that is, sounds propagating through air external to the ear, as well as sounds propagating through the case 12.

A second internal microphone 30 is also in electrical communication with the electronics package 22 by, for example, a twisted pair of wires 32. The internal microphone is enclosed in a further enclosure 34 that seals the internal microphone from sounds propagating through free air. Thus, the internal microphone is only able to pick up sounds propagating through the hearing aid shell 14 and the enclosure 34. The internal and external microphones are preferably identical such that the responses of both microphones to audio inputs have substantially the same audio to electrical conversion characteristics. The electronics package 22 contains subtractive circuitry for eliminating noises propagated through the hearing aid case, as discussed above in conjunction with FIGS. 1–5.

The hearing aid also includes a loudspeaker 40, connected to the electronics package 22 via a twisted pair of wires 42, placed at a proximal end 44 of the shell 14 to direct audio output into the ear of the hearing aid wearer. A battery 46, covered by a protective covering 48, is provided to supply power for the hearing aid. The battery is also connected to the electronics package by, for example, a twisted pair of wires 50.

Figure 7:
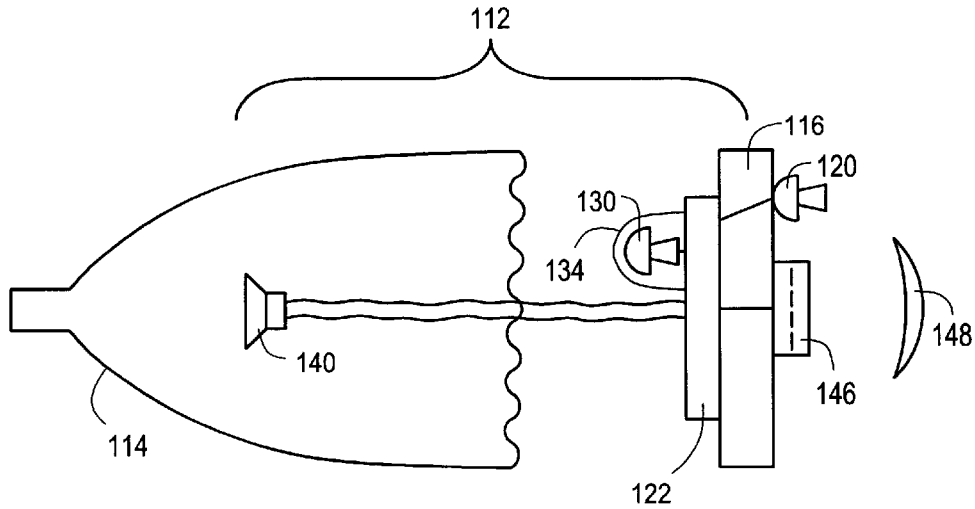
FIG. 7 is an exploded view of a further embodiment of a hearing aid according to the present invention.

In an alternative embodiment, illustrated in FIG. 7, all of the working components of the hearing aid except a loudspeaker 144 are mechanically connected to a faceplate 116 of a case 112. An external microphone 120 is connected directly to an electronics package 122 via contacts that pass through the faceplate 116 to a distally facing side of the package. A battery 146, covered by a protective cover 148, is similarly directly connected to the electronics package 122 via contacts that pass through the faceplate to the distally facing side of the package. A second internal microphone 130 is attached to a proximally facing side of the electronics package 122 and is enclosed in an enclosure 134 sealed from the air both inside and outside of the case. In this manner, these working components can be assembled and fitted into any shell 114. In addition, the external and internal microphones are mechanically connected together and are as close together as possible in order to receive identical audio signals transmitted through the plastic case 112. The electronics package 122 contains subtractive circuitry for eliminating noises propagated through the hearing aid case, as discussed above in conjunction with FIGS. 1–5.

Figure 8:
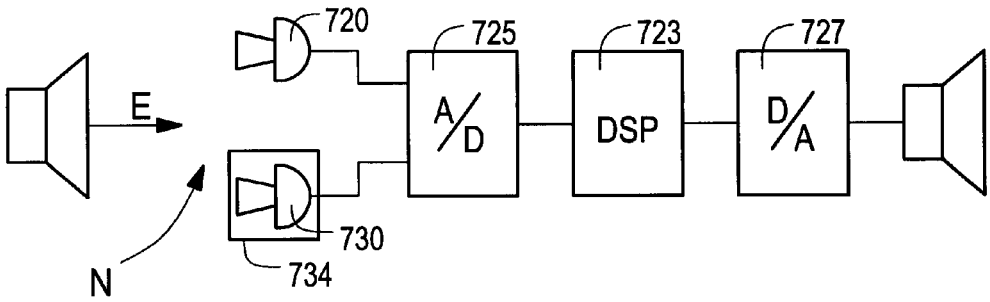
FIG. 8 is a schematic diagram of a further embodiment of the circuitry of the present invention.

Other alternatives and variations are possible according to the present invention. For example, as illustrated in FIG. 8, the subtractive circuitry in the electronics package may include a suitable digital signal processor 723 and appropriate analog-to-digital and digital-to-analog converters 725, 727. The digital signal processor may be operative to use an audio test signal to adjust the electrical gain and phase of one microphone to minimize audio signals propagating through the hearing aid shell from appearing in the resulting electrical signal. The gain and phase of the audio signal from one microphone 720 can be varied with respect to the second microphone 730 to minimize the audio signals propagated through the hearing aid case from being present in the resulting electrical signal.

Figure 9:
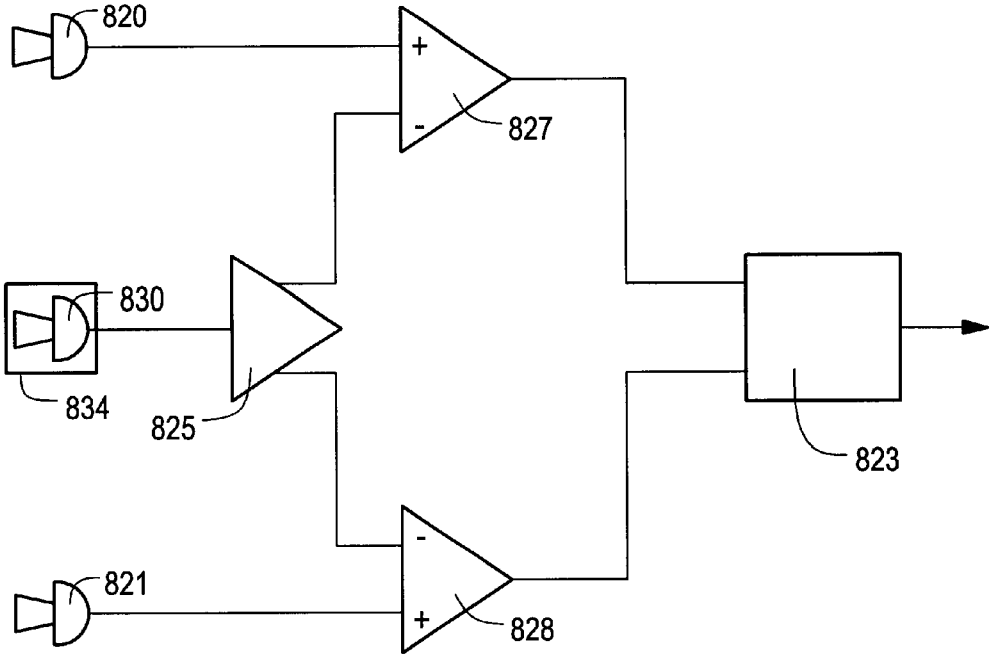
FIG. 9 is a schematic diagram of a further embodiment of the present invention in which two microphones receive audio signals through free air and a third microphone is sealed from external audio signals through fee air.

In a further embodiment of the invention, illustrated in FIG. 9, a hearing aid employs two microphones 820, 821 that form a directional microphone by processing the signals from the two microphones using a suitable signal processor 823, as known in the art. A third microphone 830 is provided, isolated from free air in an enclosure 834 as described above. The third microphone 830 is mechanically attached to the same structure as the first and second microphones 820, 821. The output of the third microphone is directed to a buffer amplifier 825 with a gain of one. The buffer amplifier provides two identical output signals from the microphone 830.

The outputs of the buffer amplifier are introduced to two separate difference devices, such as differential amplifiers 827, 828, at which the signals from the first and second microphones 820, 821 are subtracted from the signal from the third, sealed microphone 830. In this manner, any sound propagated through the shell of the hearing aid is subtracted from the signals from the two microphones 820, 821 exposed to free air independently before the signals from the two free air microphones enter the signal processor 823. Thus, any sound propagated through the shell is eliminated from both microphones 820, 821 before the audio signals are processed to provide directional information and to eliminate other types of "external" noise.

In an alternative, the subtraction and signal processing may be performed in a single signal processor. Thus, the signal from the third microphone may be sent directly to the signal processor, eliminating the buffer amplifier and the two differential amplifiers, although use of the buffer amplifier and two differential amplifiers is preferred.

Although the invention has been particularly described with respect to an in-the-ear type of hearing aid, the invention can also be implemented in a behind-the-ear type of hearing aid.

The invention is not to be limited by what has been particularly shown and described, except as indicated by the appended claims.

What is claimed is:

1. A hearing aid comprising:

a hearing aid case configured to be worn by a person;

a first microphone fixed to the hearing aid case and exposed to sound originating in free air and sound propagating through the hearing aid case;

a second microphone fixed to the hearing aid case and sealed from sound propagating through air and exposed to sound propagating through the hearing aid case;

subtractive circuitry operative to receive electrical outputs from the first microphone and the second microphone and to subtract one of the electrical outputs from the other of the electrical outputs to produce a resulting electrical signal in which audio signals which are propagated thorough the hearing aid case are minimized and audio signals received through the air are passed; and a transducer element operative to change the resulting electrical signal into an audio signal.

2. The hearing aid of claim 1, wherein the first microphone and the second microphone have substantially the same audio to electrical conversion characteristics.

3. The hearing aid of claim 1, wherein the subtractive circuitry comprises a differential input operational amplifier.

4. The hearing aid of claim 1, wherein the subtractive circuitry comprises a digital signal processor.

5. The hearing aid of claim 4, wherein the digital signal processor is operative to produce at least one audio test signal out of the transducer element.

6. The hearing aid of claim 5, wherein the digital signal processor is operative to use the audio test signal to adjust the electrical gain and phase of the first microphone with respect to the second microphone to minimize the audio signals propagated through the case of the hearing aid from appearing in the resulting electrical signal.

7. The subtractive circuit of claim 1, wherein the gain and phase of the audio signal from one microphone can be varied with respect to the second microphone to minimize the audio signals propagated through the case of the hearing aid from appearing in the resulting electrical signal.

8. The hearing aid of claim 1, wherein the second microphone is enclosed in a sealed enclosure within the hearing aid case.

9. The hearing aid of claim 8, wherein the sealed enclosure is fixed to the hearing aid case.

10. The hearing aid of claim 8, wherein the sealed enclosure is fixed to the subtractive circuitry.

11. The hearing aid of claim 1, wherein the second microphone is enclosed in a sealed enclosure fixed to the outside of the hearing aid case.

12. The hearing aid of claim 11, wherein the sealed enclosure is fixed to the subtractive circuitry.

13. The hearing aid of claim 1, wherein the distance between the first microphone and the second microphone is minimized.

14. The hearing aid of claim 1, wherein the hearing aid case is configured to fit in an ear of the person.

15. The hearing aid of claim 1, wherein the hearing aid case is configured to fit behind an ear of the person.

16. The hearing aid of claim 1, wherein the hearing aid case comprises a shell and a faceplate.

17. The hearing aid of claim 16, wherein the shell is molded to fit an ear of the person.

18. The hearing aid of claim 16, wherein the first microphone is attached to an outer surface of the faceplate and the second microphone is attached to the inner surface of the faceplate.

19. The hearing aid of claim 16, wherein the first microphone is attached to an outer surface of the faceplate and the subtractive circuitry is attached to the inner surface of the faceplate.

20. The hearing aid of claim 16, wherein the first microphone is attached to an outer surface of the faceplate and the second microphone and the subtractive circuitry are attached to an inner surface of the faceplate.

21. The hearing aid of claim 16, wherein the first microphone is attached to an outer surface of the faceplate, one side of the subtractive circuitry is attached to an inner surface of the faceplate, and a second side of the subtractive circuitry is attached to the second microphone.

22. The hearing aid claim of 16, wherein the transducer element operative to change the resulting electrical signal into an audio signal is electrically connected to the subtractive circuitry by a pair of twisted wires.

23. The hearing aid of claim 1, further comprising a power source in communication with the subtractive circuitry.

24. The hearing aid of claim 23, wherein the power source comprises a battery.

25. The hearing aid of claim 1, wherein the transducer element operative to change the resulting electrical signal into an audio signal is electrically connected to the subtractive circuitry by a pair of twisted wires.

26. The hearing aid of claim 1, further comprising:

a third microphone fixed to the hearing aid case and exposed to sound originating in free air and sound propagating through the hearing aid case;

wherein the subtractive circuitry is further operative to receive electrical outputs from the third microphone and to subtract one of the electrical outputs from the other two of the electrical outputs to produce a resulting electrical signal in which audio signals which are propagated through the hearing aid case are minimized and audio signals received through the air are passed; and directional circuitry operative to provide directional information from the passed audio signals.

27. The hearing aid of claim 26, wherein the subtractive circuitry comprises a buffer amplifier operative to provide two identical signals and two differential amplifiers operative to receive the signals from the buffer amplifier.

28. The hearing aid of claim 26, wherein the directional circuitry comprises a signal processing element.

29. The hearing aid of claim 28, wherein the signal processing element further includes the subtractive circuitry.

30. A hearing aid comprising:

a hearing aid case configured to be worn by a person;

a first microphone fixed to the hearing aid case and exposed to sound propagating through free air and sound propagating through the hearing aid case;

a second microphone fixed to the hearing aid case and sealed from sound propagating through air and exposed to sound propagating through the hearing aid case;

subtractive means for receiving electrical outputs from the first microphone and the second microphone and subtracting one of the electrical outputs from the other of the electrical outputs to produce a resulting electrical signal representative of audio signals transmitted through air; and a transducer element operative to change the resulting electrical signal into an audio signal.

31. The hearing aid of claim 30, wherein the first microphone and the second microphone have substantially the same audio to electrical conversion characteristics.

32. The hearing aid of claim 30, wherein the subtractive means comprises a differential input operational amplifier.

33. The hearing aid of claim 30, wherein the subtractive means comprises a digital signal processor.

34. The hearing aid of claim 33, wherein the digital signal processor is operative to produce at least one audio test signal out of the transducer element.

35. The hearing aid of claim 34, wherein the digital signal processor is operative to use the audio test signal to adjust an electrical gain and phase of one of the first microphone and the second microphone to minimize audio signals propagating through the hearing aid case from appearing in the resulting electrical signal.

36. The hearing aid of claim 30, wherein a gain and phase of an audio signal from one of the first microphone and the second microphone are variable with respect to another of the first microphone and the second microphone to minimize audio signals propagating through the hearing aid case from being present in the resulting electrical signal.

37. The hearing aid of claim 30, wherein the second microphone is enclosed in a sealed enclosure within the hearing aid case.

38. The hearing aid of claim 37, wherein the sealed enclosure is fixed to the hearing aid case.

39. The hearing aid of claim 37, wherein the sealed enclosure is fixed to the subtractive circuitry.

40. The hearing aid of claim 30, wherein the second microphone is enclosed in a sealed enclosure fixed to an outside of the hearing aid case.

41. The hearing aid of claim 40, wherein the sealed enclosure is fixed to the subtractive circuitry.

42. The hearing aid of claim 30, wherein a distance between the first microphone and the second microphone is minimized.

43. The hearing aid of claim 30, wherein the hearing aid case is configured to fit in an ear of the person.

44. The hearing aid of claim 30, wherein the hearing aid case is configured to fit behind an ear of the person.

45. The hearing aid of claim 30, wherein the hearing aid case comprises a shell and a faceplate.

46. The hearing aid of claim 45, wherein the shell is molded to fit an ear of the person.

47. The hearing aid of claim 45, wherein the first microphone is attached to an outer surface of the faceplate and the second microphone is attached to an inner surface of the faceplate.

48. The hearing aid of claim 45, wherein the first microphone is attached to an outer surface of the faceplate and the subtractive circuitry is attached in an inner surface of the faceplate.

49. The hearing aid of claim 45, wherein the first microphone is attached to an outer surface of the faceplate and the second microphone and the subtractive circuitry are attached to an inner surface of the faceplate.

50. The hearing aid of claim 45, wherein the first microphone is attached to an outer surface of the faceplate, one side of the subtractive circuitry is attached to an inner surface of the faceplate, and a second side of the subtractive circuitry is attached to the second microphone.

51. The hearing aid of claim 30, further comprising a power source in communication with the subtractive means.

52. The hearing aid of claim 51, wherein the power source comprises a battery.

53. The hearing aid of claim 1, wherein the transducer element operative to change the resulting electrical signal into an audio signal is electrically connected to the subtractive circuitry by a pair of twisted wires.

54. The hearing aid of claim 30, further comprising:

a third microphone fixed to the hearing aid case and exposed to sound originating in free air and sound propagating through the hearing aid case; and the subtractive means is further operative to receive electrical outputs from the third microphone and to subtract one of the electrical outputs from the other two of the electrical outputs to produce a resulting electrical signal in which audio signals which are propagated through the hearing aid case are minimized and audio signals received through the air are passed; and directional circuitry operative to provide directional information from the passed audio signals.

55. The hearing aid of claim 54, wherein the subtractive means comprises buffer amplifier operative to provide two identical signals and two differential amplifiers operative to receive the signals from the buffer amplifier.

56. The hearing aid of claim 54, wherein the directional circuitry comprises a signal processing element.

57. The hearing aid of claim 56, wherein the signal processing element further includes the subtractive means.

* * * * *